United States Patent [19]

Hurlburt

[11] 3,995,761

[45] Dec. 7, 1976

[54] ANTI-LOWERING DEVICE FOR A BOOM LOADER

[75] Inventor: Joseph C. Hurlburt, Leola, Pa.

[73] Assignee: Sperry Rand Corporation, New Holland, Pa.

[22] Filed: Sept. 4, 1975

[21] Appl. No.: 610,368

[52] U.S. Cl. ..... 214/776; 212/39 R; 214/140

[51] Int. Cl.[2] ..... E02F 3/16

[58] Field of Search ..... 214/131 R, 140, 142, 214/776; 187/8.47, 8.49, 8.5, 75; 172/466, 481; 212/39 R

[56] References Cited

UNITED STATES PATENTS

| | | | |
|---|---|---|---|
| 1,497,501 | 6/1924 | Graboski | 187/75 |
| 1,595,004 | 8/1926 | Haight | 187/75 |
| 3,215,292 | 11/1965 | Halls | 214/770 |
| 3,396,863 | 8/1968 | Borer et al. | 214/776 |
| 3,730,362 | 5/1973 | Hurlburt et al. | 214/140 |
| 3,918,601 | 11/1975 | Zimmerman | 214/776 |

FOREIGN PATENTS OR APPLICATIONS

| | | | |
|---|---|---|---|
| 747,342 | 4/1956 | United Kingdom | 187/75 |

*Primary Examiner*—L. J. Paperner
*Attorney, Agent, or Firm*—Michael R. Swartz; Frank A. Seemar; John R. Flanagan

[57] ABSTRACT

In a loader having a boom structure that reciprocates along its sidewalls, at least one stop member, having a cam surface and an abutment surface, is disposed at a predetermined height adjacent one of the sidewalls and operative between first and second positions. In the first position, the stop member projects outwardly from the sidewall into the path of travel of the boom structure whereby a portion of the boom structure may be lowered into engagement with the abutment surface to prohibit further downward movement of the boom structure. As the boom structure is swung upwardly and engages the cam surface, the stop member retracts inwardly to the second position, thereby permitting the boom structure to be raised above the predetermined height. Preferably, a pair of stop members, each one disposed on opposite sidewalls of the loader, may be used.

9 Claims, 7 Drawing Figures

ANTI-LOWERING DEVICE FOR A BOOM LOADER

BACKGROUND OF THE INVENTION

1. Field of the Invention

This invention relates generally to improvements in material loading and handling equipment and is specifically directed to a device to selectively prohibit a boom structure from lowering beyond a given height.

2. Description of the Prior Art

Conventional loaders are normally provided with a bucket carrying boom structure that moves up and down adjacent the outer sides of the loader. Generally, the bucket and boom structure is raised and lowered by a hydraulic lift cylinder which is interconnected between the vehicle or a support thereon and the boom structure which is actuated by a control lever in the operator's station.

For certain working situations and for other convenience reasons such as inspection, repair, maintenance, and storage, it is desirable to maintain a bucket and boom structure at a given elevation. Since many of the loaders today employ hydraulics for powering the loader boom, it is desirable to provide a secondary locking mechanism to prevent the boom structure from suddenly lowering due to a failure in the hydraulic system or an accidental movement of the control lever.

The anti-lowering device as set forth in Hurlburt et al. U.S. Pat. No. 3,730,362, issued May 1, 1973 prohibits a boom structure from being lowered beyond a predetermined height by the provision of a pair of cylindrical locking pins disposed adjacent respective sides of a loader for simultaneous longitudinal movement outwardly from the frame, such that the outer portions thereof project into the path of travel of the boom structure. The present invention is an improvement to this device in that it provides for a stop member that prohibits a boom structure from being lowered beyond a predetermined height and in addition permits the boom structure to be raised from below the predetermined height when the stop member is in its locking position.

SUMMARY OF THE INVENTION

The present invention sets forth an improved anti-lowering device for use on boom loaders. This device prohibits a boom structure from being lowered from beyond a predetermined height and also permits the structure to be raised from below to a position above the predetermined height.

According to the present invention, in a boom loader having a vehicle frame including upwardly-extending laterally-spaced side members, an operator's station on the frame including an operator's seat, a boom structure including a pair of arms and means for pivotally mounting the boom structure to the frame, and power means operably associated with the boom structure for raising and lowering in concert each of the arms along a path adjacent a corresponding side member, there is provided an anti-lowering device comprising a stop member having a cam surface and an abutment surface mounted at a predetermined height on one of the side members of the frame so that the abutment surface faces generally upwardly therefrom. The stop member is adapted to move relative to the side member between a locking position and a retracting position and is provided with means for biasing it in the locking position. In the locking position, the abutment surface projects outwardly from the side member into the path of travel of a corresponding arm so that the arm may be lowered into supporting engagement with the abutment surface of the stop member whereby further downward movement of the boom structure is prohibited. The biasing means is yieldable to permit the stop member to be urged to a retracted position under conditions where the arm is raised upwardly into engagement with the cam surface.

Specifically, the cam surface is upwardly and outwardly inclined with respect to the path of travel of the arm adjacent the loader's side member. As the arm is raised and engages the cam surface, the stop member is urged inwardly to a retracted position whereby the boom structure may be raised past the stop member and above the predetermined height defined by its abutment surface.

The present invention further comprises a means for retracting the abutment surface of the stop member inwardly towards the frame to an unlocking position whereby the arm of the boom structure may travel along an unobstructed path adjacent a corresponding side member. More particularly, the retracting means interconnects the seat member to the stop member so that the movement of the stop member between its locked and unlocked positions is responsive to up and downward movement of the seat member. Specifically, the stop member is retracted inwardly out of the path of travel of the boom structure as the seat member moves downwardly relative to the vehicle frame. Further, the stop member is extended outwardly into the path of travel of the boom structure as the seat member is moved upwardly from its donward position.

These and other advantages and attainments of the present invention will become apparent to those skilled in the art upon reading of the following detailed description when taken in conjunction with the drawings wherein there is shown and described an illustrative embodiment of the invention.

BRIEF DESCRIPTION OF THE DRAWINGS

In the course of the following detailed description reference will be frequently made to the attached drawings in which.

DETAILED DESCRIPTION OF THE INVENTION

In the following description, right hand and left hand references are determined by standing at the rear of the machine facing in a direction of forward travel. Also, in the following description, it is to be understood that such terms "forward", "rearward", "left", "upwardly", etc. are words of convenience and are not to be construed as limiting terms.

IN GENERAL

Figure 1:
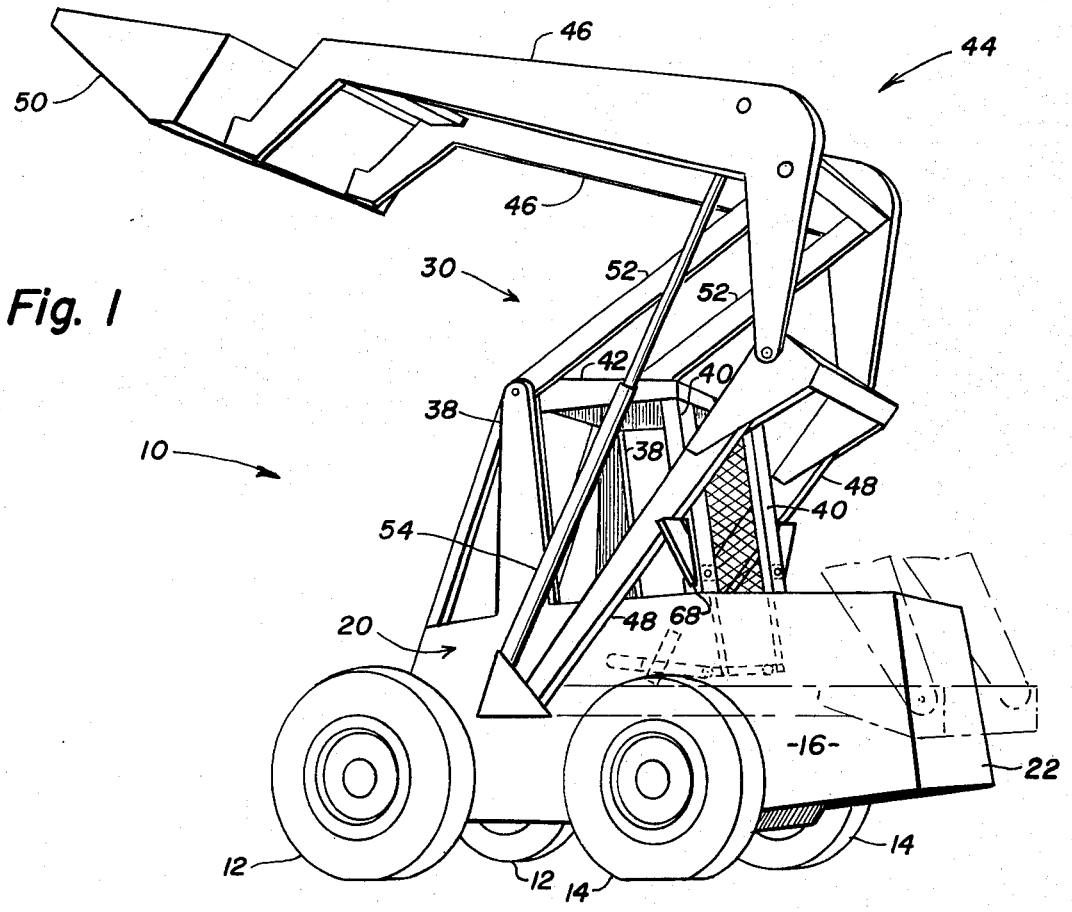
FIG. 1 is a perspective view of a loader having a boom structure in a raised position and with the anti-lowering device of the present invention engaged with the boom structure for prohibiting the boom structure from lowering beyond a predetermined height.
Figure 2:
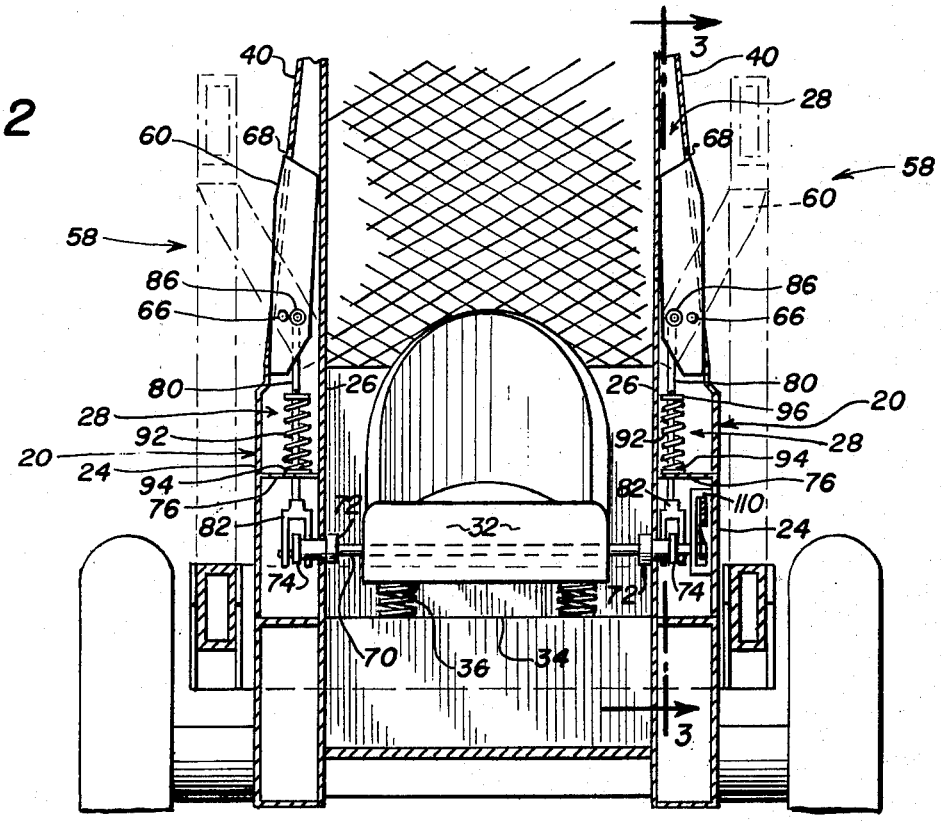
FIG. 2 is an enlarged partial front elevational view of a loader with the vehicle frame and boom structure partially in sectional form, showing in phantom the anti-lowering device of the present invention engaged with the boom structure and showing the linkage arrangement for actuation of the stop members.

Referring now to the drawing and particularly to FIGS. 1 and 2, there is shown a front end loader, being indicated generally by the numeral 10, forming the preferred embodiment of the present invention. Although the front end loader illustrated is of the type employing a four bar linkage lift system, the principles of the invention may just as readily be incorporated into any type of loader.

The loader 10 is provided with front and rear pairs of drive wheels 12, 14 which are rotatably mounted to and support on vehicle frame 16. The frame 16 includes a pair of laterally spaced sidewalls 20 and has rear engine compartment 22. Sidewalls 20 have outer and inner walls 24, 26 respectively forming chamber 28 therebetween. The rear engine and related components are not shown since they are of conventional construction and not material to the present invention.

A cab 30 is defined on the frame 16 and encloses an operator's station which includes seat member 32 mounted above a support structure 34, being fixed on the floor of vehicle frame 16, by four coil springs 36 (only two being shown in FIG. 2). The sidewalls 20 have upper extensions in the form of front and rear pairs of posts 38, 40 which together with a roof structure 42 fixed to the top thereof define the vehicle cab 30.

The loader 10 further includes a boom structure, indicated generally by numeral 44 in FIG. 1. Boom structure 44 is basically comprised of a pair of corresponding upper arms 46 and corresponding lower arms 48. The lower arms 48 are pivotally mounted to respective sidewalls 20 of the loader 10 and extend generally rearwardly therealong. Each upper arm 46 has one end extremity pivotally connected to the rearmost extremity of lower boom arm 48 and extends generally upwardly therefrom for a short distance and then bends generally forward and projects therefrom past the forwardmost portion of loader 10. For front portions of the upper arms 46 are adapted to receive a material handling implement, such as bucket 50 as shown in the preferred embodiment.

To support the boom structure 44 and to provide additional guidance therefor, a pair of support links 52 are respectively pivotally interconnected between the upper ends front posts 3i of the sidewalls 20 and rear portions of upper arms 46. As in most commercial heavy duty loaders, the boom structure 44 is powered by hydraulics, preferably, by two hydraulic cylinders 54 (only one being shown in FIG. 1) which are pivotally connected at their cylinder ends to respective sidewalls 20 of the loader just above the pivotal connections of the lower arms 48 with the loader sidewalls 20. The rod portions of cylinders 54 are respectively pivotally connected at rear intermediate points on the upper arms 46. Although the boom structure has been described briefly, a more detailed appreciation and understanding of the boom structure can be gained from a study of U.S. Pat. No. 3,215,292 granted to L. M. Halls on Nov. 2, 1956.

IMPROVED ANTI-LOWERING DEVICE

Figure 4:
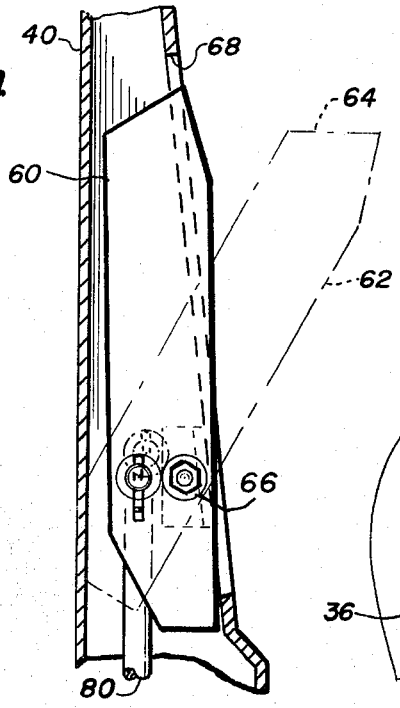
FIG. 4 is an enlarged fragmentary view taken along the line 4—4 of FIG. 3, on a somewhat larger scale, showing the stop member in the locked and unlocked positions.

The anti-lowering device for the loader's boom structure 44 is indicated generally by numeral 58 and is shown particularly in FIG. 2. The anti-lowering device 58 has a pair of stop members 60, each including a cam surface 62 and an abutment surface 64, as best shown in FIG. 4. Each stop member 60 is pivotally mounted at its lower end portion within rear support posts 40 of sidewalls 20 by pin 66 so that the abutment surface 64 faces generally upwardly. When actuated, each stop member 60 pivots about pin 66 outwardly from chamber 28 through slot 68 formed in rear support post 40 and into the path of travel of one of the lower arms 48 along one of the sidewalls 20. Although, in the preferred embodiment of the present invention, a pair of stop members 60 is utilized, it should be understood that the same advantages apply when only one stop member is utilized.

Figure 3:
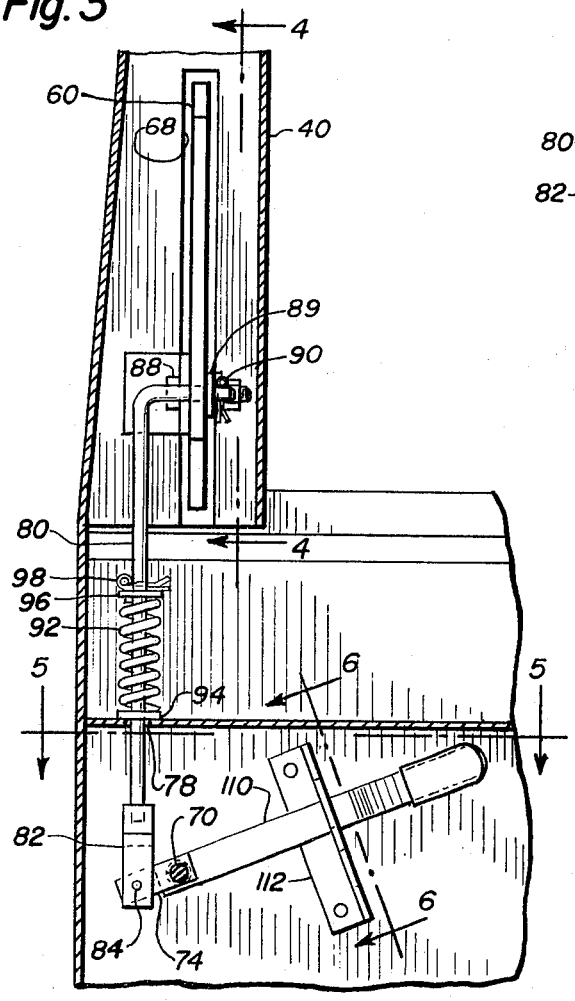
FIG. 3 is an enlarged fragmentary view taken along the line 3—3 of FIG. 2 showing the stop member, the linkage arrangement and the control lever.
Figure 5:
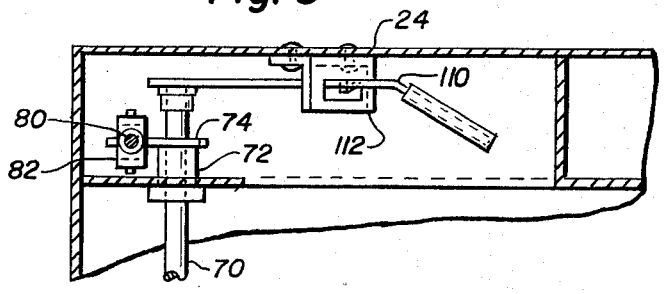
FIG. 5 is a fragmentary plan view taken along the line 5—5 of FIG. 3 showing the control lever in more detail.

Simultaneous actuation of stop members 60 is provided by a rotatably mounted actuator rod 70 located behind operator's seat 32 and extending laterally thereacross with the outer portion thereof extending slightly through inner walls 26 of the sidewalls 20 and terminating within chamber 28. Actuator rod 70 is journalled for rotation within collars 72, each mounted to a respective inner wall 26 of one sidewall 20. Link arm 74 is welded to the outer end portion of actuator rod 70 and projects radially outwardly therefrom. Disposed above link arm 74 and within chamber 28 is laterally extending guide plate 76 having central opening 78 therein and being secured between inner and outer walls 24, 26 of each sidewall 20. Connector rod 80 pivotally connects link arm 74 to stop member 60. One end of connector rod 80 is secured to clevis 82 that attaches to link arm 74 by pin 84. The other end of connector rod 80 is hooked shaped and passes through stop member 60 at point 86 adjacent pin 66. As best seen in FIG. 3, the hook end portion of connector rod 80 is supported on stop member 60 by pin 88 that passes through connector rod 80 adjacent the back side of stop member 60 and by retainor 89 inserted around connector rod 80 in front of stop member 60, and abutting pin 90 that passes through the terminal end of connector rod 80. Stop member 60 is biased outwardly in a locking position by coil spring 92 that extends around connector rod 80 and is confined in a state of compression between washer 94, inserted around connector rod 80 and resting on guide plate 76, and washer 96 also inserted around connector rod 80 and abutting cotter pin 98 that passes through the connector rod 80.

In referring to FIGS. 2 and 3, it is noted that connector rod 80 connects the stop member 60 to the link arm 74 which is secured to the outer end portion of actuator rod 70 so that rotational movement of actuator rod 70 causes the stop member 60 to pivot about pin 66. Therefore, as actuator rod 70 is rotated in a counterclockwise direction, link arm 74 pulls connector rod 80 downwardly which in turn pivots stop member 60 inwardly about pin 66 towards sidewall 20 to a retracted position whereby lower boom arm 48 is permitted to reciprocate adjacent sidewall 20. In the reverse operation, as actuator rod 70 is rotated in a clockwise direction, connector rod 80 pushes upwardly at point 86, thereby causing stop member 60 to pivot about pin 66 outwardly into the path of movement of boom structure 44. It is noted, that since coil spring 92 is under compression, connector rod 80 pushes upwardly and forces stop member 60 to pivot outwardly about pin 66 to the locking position. However, as lower arm 48 is raised upwardly from a position below the stop member 60 and engages the cam surface 62 and urges stop member 60 inwardly to a retracted position, coil spring 92 is further compressed and causes actuator 70 to rotate in a counterclockwise direction. As arm 48 raises above stop member 60, coil spring 92 forces the stop member 60 outwardly again to the locking position.

Figure 6:
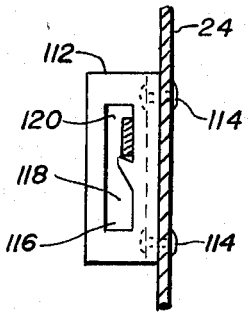
FIG. 6 is a fragmentary view taken along the line 6—6 of FIG. 3 showing the control lever bracket and the control lever in unlocked position.

To provide for quick and convenient actuation of stop members 60, a side linkage is provided that is particularly disposed adjacent the operator's seat 32. This linkage arrangement is shown in FIG. 3, and is basically comprised of a handle 110 that is fixedly secured to actuator rod 70 adjacent link arm 74 so that as handle 110 is moved downwardly and upwardly, actuator rod 70 rotates clockwise and counterclockwise respectively. The handle 110 is confined by bracket 112 mounted to sidewall 20 by a pair of mounting screws 114 and contains a slotted aperature 116 having two indented positions representing locked and unlocked positions 118, 120 respectively, as shown in FIG. 6. The locked position 118 is of sufficient length to allow the handle 110 to be moved upwardly within the locked position when the boom arm 48 is raised past and causes pivoting of the stop member 60 inwardly to its unlocking position; then when the boom arm passes the stop member 60 and the latter returns to its locked position, the handle 110 will still be within locked position 118.

Figure 7:
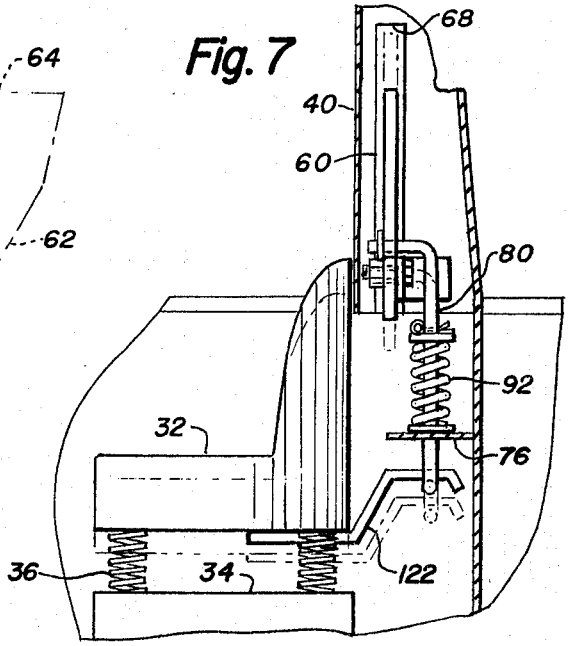
FIG. 7 is a fragmentary view of an alternative form of the anti-lowering device wherein it is operably connected to an operator's seat member.

In FIG. 7 another embodiment of the invention is shown. Stop members 60 with connector rod 80, coil spring 92, and guide plates 76 are identical to and mounted in the same matter as described in the preferred embodiment. The difference is that the lower end of connector rod 80 is connected to the bottom side of seat member 32 by actuator rod 122 so that downward movement of the seat member 32 causes connector rod 80 to move downwardly, which in turn pivots stop member 60 inwardly and out of the path of movement of the boom structure 44. As the seat member 32 moves upwardly to its normal rest position, stop member 60 pivots outwardly about pin 66 to the locking position.

OPERATION

From the foregoing discussion it can be seen that as boom structure 44 is raised to an elevated position and the operator desired to maintain the boom structure in such position for a period of time, he will actuate the anti-lowering device 58 in a manner as just described. When the anti-lowering device 58 is actuated, stop members 60 extend outwardly from sides 20 of main frame 16 so as to protrude through the vertical plane of the lower arms 48. Should a failure occur in the hydraulic system, or for any other reason the boom structure 44 should begin to fall, the presence of the stop member 60 in an extended locking position as shown in FIG. 1 will prevent boom structure 44 from lowering beyond a predetermined height. Additionally, it can be seen that as boom structure 44 is raised from below to a position above the stop member 60, upper and lower arms 48, 46 engage with cam surface 66 to urge stop member 60 inwardly to a retracted position and thereby permit further upward movement of boom structure 44. As boom structure 44 is raised above stop member 60, coil spring 92 forces connector rod 80 upwardly which in turn causes stop member 60 to pivot about pin 66 outwardly to a locking position.

It is obvious from the foregoing discussion, that the present invention has the advantage of being simple and easy to construct while performing a useful and worthwhile function in the loader. Moreover, the present anti-lowering device is disposed in a location which lends convenience to the operator in actuating the stop members between retracted and extended positions.

The present invention of course, may be carried out in other specific ways than those herein set forth without departing from the spirit and essential characteristics of the invention. The present embodiments are, therefore, to be considered in all respects as illustrated and not restricted and all changes coming within the meaning and equivalency range are intended to be embraced herein.

Having thus described the invention, what is claimed is:

1. An improved anti-lowering device for a boom loader having a frame including upwardly-extending laterally-spaced side members, a boom structure including a pair of arms and means for pivotally mounting said boom structure to the frame, and power means operably associated with said boom structure for raising and lowering in concert each of said arms along a path adjacent a corresponding side member, said anti-lowering device comprising:

a. a stop member including a cam surface and an abutment surface;

b. means for mounting the stop member at a predetermined height on one of the side members of the frame so that said abutment surface faces generally upwardly;

c. means for moving said stop member relative to said side member between a locking position and a retracted position;

d. means acting upon said moving means for biasing said stop member in the locking position with its abutment surface projecting outwardly from said side member into the path of travel of the corresponding arm so that said arm may be lowered into supporting engagement with said abutment surface to prohibit movement of said boom structure beyond a given height; and e. said biasing means yieldable to permit said stop member to be urged to said retracted position under conditions where said arm is raised upwardly into engagement with said cam surface.

2. The moving means as recited in claim 1, further comprising means for retracting the abutment surface of said stop member inwardly towards the frame and out of the path of travel of said arm whereby said arm may travel along an unobstructed path adjacent a corresponding side member.

3. An improved anti-lowering device as recited in claim 1, wherein said cam surface is upwardly and outwardly inclined with respect to the path of travel of said arm when said stop member is in the locking position and is substantially coplanar with aid upwardly extending side member when said stop member is in the retracted position.

4. An improved anti-lowering device as recited in claim 1, further comprising:

a second stop mounted at a predetermined height on the opposite side member of said frame, the second stop including a portion having a cam surface and an abutment surface;

means for biasing said second stop in a locking position, said means yieldable to a retracted position; and means interconnecting said stops for simultaneously releasing the same from a locking position.

5. An anti-lowering device as recited in claim 1, wherein:

said moving means includes an actuating lever mounted on said frame and moveable between first and second positions, and means interconnecting said stop member and said actuating lever so as to move said stop member between its locking and retracted position respectively as said actuating lever is moved between its first and second positions;

said biasing means being operably arranged with said interconnecting means so as to yieldably bias said stop member in its locking position.

6. An anti-lowering device as recited in claim 5, wherein:

said interconnecting means includes an elongated member; and said biasing means comprises a spring encompassing a portion of said elongated member and confined between said frame and a fixed position on said elongated member.

7. An improved anti-lowering device for a boom loader mounted on a vehicle having an operator's station including an operator's seat, a frame including upwardly-extending laterally-spaced side members, a boom structure including a pair of arms and means for pivotally mounting said boom structure to the frame, and power means operably associated with said boom structure for raising and lowering in concert each of said arms along a path adjacent a corresponding side member, said anti-lowering device comprising:

a. a stop member;

b. means for mounting the stop member at a predetermined height adjacent one side member and spaced inwardly of the vertical plane of a respective arm, said stop member being movable between an outwardly extendible locking position and an inwardly retractable unlocking position;

c. means for biasing said stop member in a locking position wherein a portion of said stop member projects outwardly from said side member through the path of movement of a respective arm, the outwardly projecting portion comprising a cam surface and an abutment surface, the abutment surface engages the lower surface of said arm as said arm is lowered from a position above the predetermined height and thereby prohibits further downward movement of said arm;

d. said biasing means yieldable inwardly towards said frame to a retracted position as said arm is raised from a position below said predetermined height and engages said cam surface of the stop memnber; and e. means for retracting said stop member inwardly towards the frame and out of the path of movement of said arm to an unlocking position for unobstructed travel of said arm along a path adjacent said side member, said retracting means in interconnected to said seat member and operably associated therewith so that said stop member is retracted inwardly to the unlocking position as said seat member is moved downwardly with respect to said vehicle and as said seat member moves upwardly from its downward position, the stop member is extended outwardly to the locking position.

8. An anti-lowering device as recited in claim 7, wherein, said cam surface is inclined upwardly and outwardly into the path of movement of said arm when said stop member is in the locking position and is coplanar with said side member when said stop member is in the unlocking position.

9. An anti-lowering device as recited in claim 8, wherein, said abutment surface faces generally upwardly from the mounting of said stop and is adjacent to and spaced above said cam surface.

* * * * *